US009957720B1

(12) United States Patent
Brunner

(10) Patent No.: US 9,957,720 B1
(45) Date of Patent: May 1, 2018

(54) RETRACTABLE STAIRCASE AND METHOD

(71) Applicant: MAJIC STAIRS INC., Ocala, FL (US)

(72) Inventor: Ronald N. Brunner, The Villages, FL (US)

(73) Assignee: MAJIC STAIRS INC., Ocala, FL (US)

( * ) Notice: Subject to any disclaimer, the term of this patent is extended or adjusted under 35 U.S.C. 154(b) by 0 days. days.

(21) Appl. No.: 15/361,109

(22) Filed: Nov. 25, 2016

Related U.S. Application Data

(60) Provisional application No. 62/259,937, filed on Nov. 25, 2015.

(51) Int. Cl.
*E04F 11/04* (2006.01)
*E06C 1/34* (2006.01)
*E04F 11/02* (2006.01)

(52) U.S. Cl.
CPC ..... *E04F 11/04* (2013.01); *E06C 1/34* (2013.01); *E04F 2011/0203* (2013.01)

(58) Field of Classification Search
CPC ..... E04F 11/04; E04F 11/06; E04F 11/064; E04F 11/068; E04F 2011/0203; E06C 1/34; E06C 1/345
See application file for complete search history.

(56) References Cited

U.S. PATENT DOCUMENTS 1,219,696 A * 3/1917 Bessler ..... E04F 11/04 182/106
1,219,697 A * 3/1917 Bessler ..... E04F 11/04 182/79
1,594,655 A * 8/1926 Bessler ..... E04F 11/04 182/80
1,614,006 A 1/1927 Loetscher
1,636,279 A * 7/1927 Bessler ..... E04F 11/04 182/80
1,636,280 A * 7/1927 Bessler ..... E04F 11/04 182/80
1,636,281 A * 7/1927 Bessler ..... E04F 11/04 182/80
1,749,409 A * 3/1930 Bessler ..... E04F 11/04 182/80

(Continued)

*Primary Examiner* — Katherine W Mitchell
*Assistant Examiner* — Shiref M Mekhaeil
(74) *Attorney, Agent, or Firm* — Frijouf, Rust & Pyle, P.A.

(57) ABSTRACT

A retractable staircase is disclosed for ascending and descending between a lower elevation and an upper elevation. The retractable staircase comprises a main frame and staircase pivotally coupled to an upper surface. A drive causes a first lifting displacement defining an ascending compound displacement by simultaneously causing an ascending pivot displacement and an ascending slide displacement of the staircase. The drive causes a second lifting displacement defining only the ascending staircase pivot displacement and the ascending frame pivot displacement. The drive maintains the staircase in the upper elevation. The drive causes a first descending displacement defining only a descending staircase pivot displacement. The drive causes a second descending displacement defining a descending compound displacement by simultaneously causing the descending staircase pivot displacement and the descending slide displacement of the staircase. The drive causes an extended length in the tether for positioning the staircase in the lower elevation.

15 Claims, 13 Drawing Sheets

(56) References Cited

U.S. PATENT DOCUMENTS 1,802,401 A * 4/1931 Bessler ..... E04F 11/04 182/79
1,811,707 A * 6/1931 Bessler ..... E04F 11/04 182/80
1,811,709 A * 6/1931 Bessler ..... E04F 11/068 182/80
1,858,981 A * 5/1932 Bessler ..... E04F 11/04 182/80
1,930,992 A * 10/1933 Bessler ..... E04F 11/04 182/80
2,203,086 A * 6/1940 Garner ..... E04F 11/04 182/80
2,564,954 A 8/1951 Brelsford
2,572,281 A 10/1951 Pierce
2,577,914 A * 12/1951 Pfahl ..... E04F 11/04 182/80
2,593,336 A 4/1952 Nixon
2,649,237 A 8/1953 Bjorklund et al.
2,931,456 A 4/1960 Harmon
3,408,959 A 11/1968 Cripe et al.
3,789,955 A * 2/1974 Knapp ..... E04F 11/04 182/78
3,985,202 A 10/1976 Harmon
4,157,742 A 6/1979 Aanensen
4,541,508 A 9/1985 Lundh
4,787,111 A 11/1988 Pacek et al.
5,111,906 A * 5/1992 Abadia ..... E06C 9/06 182/163
5,174,411 A * 12/1992 Oliver ..... E06C 9/10 182/77
5,239,795 A 8/1993 Breaux
5,626,440 A 5/1997 Greene, Jr. et al.
6,739,100 B1 5/2004 Lewandowski
6,802,392 B1 10/2004 Davis
6,866,118 B1 3/2005 Battenberg
6,886,661 B1 * 5/2005 Battenberg ..... E06C 9/08 182/77
7,621,374 B2 11/2009 Richey
7,870,932 B2 1/2011 Lapke et al.
8,028,804 B2 10/2011 Lair
2007/0181364 A1 8/2007 Lair
2008/0179137 A1 7/2008 Latimer et al.
2009/0166129 A1 * 7/2009 Siler ..... E04F 11/1834 182/158
2009/0255757 A1 10/2009 Burke
2010/0192487 A1 * 8/2010 Thornton ..... E04F 11/064 52/183
2012/0005972 A1 1/2012 Burke
2012/0199417 A1 8/2012 Richey et al.
2015/0047273 A1 2/2015 Whitten et al.

* cited by examiner

RETRACTABLE STAIRCASE AND METHOD

FIELD OF THE INVENTION

This invention relates to staircases and more particularly to a retractable staircase and method of retracting a staircase.

BACKGROUND OF THE INVENTION utilizing a staircase for transitioning an individual or object from a lower elevation to an upper elevation has many advantages. For example, the area of a structure may be many types multiplied by utilizing both a lower elevation and an upper elevation as opposed to utilizing solely the lower elevation. The additional space being utilized maybe for the purpose of storage, office space and or resident space. By utilizing this additional space the occupier may save money by not renting outside rental space.

Although utilizing the additional space in an upper elevation may be advantageous, the storage of a staircase may be problematic, positioning the staircase for utilization may be time-consuming and the process of traversing the staircase by an individual may be dangerous.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 1,594,655 to Bessler discloses a frame, a shaft supported for rotation on the frame. A first drum is fixed to the shaft. A second-drum is rotatable on the shaft and partly enclosed by the first drum. A torsion spring is connected to the second drum and to the shaft. A stub shaft is supported on the frame. A roller is on the stub shafts. A guide plate is mounted to swing on the stub shaft. A panel is hinged to the frame. A stairway is slidable on the panel and on the roller. The stairway is slidable on the guide plate. A first flexible element is connected at its—ends to—the first drum and to the stairway. A second flexible element is connected at its ends to the second drum and to the panel. Means are on the frame for guiding the inter mediate portion of the second-flexible element.

U.S. Pat. No. 1,614,006 to Loetscher discloses a horizontally disposed door frame, a vertically swingable door hinged at one end of the frame, spaced pairs of pulleys mounted on the door, one pair being arranged near the inner end of the door, and the other pair near the other end of the latter. A stairway is slidably mounted on the door. The pulleys are arranged at opposite sides of the stairway. Brackets are mounted at the other end of the frame. A shaft is carried by the brackets. Spaced drums are mounted at the ends of the shaft. A coiled spring are in each drum having one of its ends connected to the shaft and its other end connected to the drum. Cables connect the drums to opposite sides of the stairway. Each cable extends from a drum under one pulley of each pair of pulleys, and from the pulley nearest the hinge of the door, to the stairway.

U.S. Pat. No. 1,636,279 to Bessler discloses a frame, a latch pivoted to the frame and having a hook, a bell crank lever fulcrumed on the frame and comprising first and second anus. The first arm has a longitudinal cam edge. A friction slide cooperates with the frame. A connection is between the slide and the latch. A connection is between the slide and the bell crank lever. A keeper and means for supporting the keeper for engagement with the hook. The second arm of the bell crank and the keeper are relatively movable in one direction to cause engagement between the keeper and the second arm of the bell crank lever, and being relatively movable in an opposite direction to cause engagement between the longitudinal cam edge and the keeper.

U.S. Pat. No. 1,636,280 to Ressler discloses a support, an upper pulley carried for rotation on the support, a panel is hinged to the support for vertical swinging movement. A lower pulley is journaled on the panel. A spring-actuated drum is mounted on the support. A stairway means for mounting the stairway for sliding movement longitudinally of the panel. A flexible element is wound about the drum, the flexible element being extended downwardly around the lower rearwardly along the panel, about the upper pulley, and downwardly and forwardly along the stairway. Means for connecting the forward end of the flexible element to the stairway.

U.S. Pat. No. 1,636,281 to Bessler discloses a support, a panel hinged to the support, a stairway slidable longitudinally of the panel and having a longitudinal groove. A standard is on the panel. A guide block is pivoted to the standard and is received slidably in the groove. A hanger is on the support. An arm is pivoted to the hanger. A guide is carried by the arm and is received slidably in the groove. Means for lifting the panel and the stairway and includes a spring drum and a flexible element connected to the drum, the panel and the stairway. A latch is mounted pivotally on the standard and comprises a part received in the groove to hold the latch disposed longitudinally of the stairway. A keeper is on the stairway and is co-operating with the latch to hold the stairway retracted. An anti-rattling spring is supported by the standard and holds the latch frictionally against the standard.

U.S. Pat. No. 1,811,709 to Bessler discloses a disappearing stairway for use in a ceiling opening between a lower floor and an upper floor. The stairway comprises pivoted brackets adjacent one end of the opening. A stair structure is slidable on the brackets. Driving means include a reversible motor in an electrical circuit for sliding the stair structure on the brackets. A radius rod is pivotally connected to the upper end of the stairway and pivotally mounted on the upper floor. A manually operable switch is on each floor arranged in the circuit for starting the motor, an automatic switch for stopping the motor and reversing its connections and means operable by the radius rod to actuate the switch as the stairway moves into its extended and retracted positions.

U.S. Pat. No. 1,858,981 to Bessler discloses a disappearing stairway of the ceiling panel type comprising in combination, a panel hinged at one end of the ceiling opening, a stair structure carried by the panel and extensible and retractible thereon to reach the lower floor. Links are pivoted at their upper ends on each side of the opening. Tracks are along, the side edges of the panels on which the lower ends of the links run. The tracks permits movement of the links beyond dead center positions perpendicular to the panel. Means are on the stair structure for engaging the links as the stair structure is extended to move the links beyond the dead center position. Means are on the stair structure for engaging the links to move them back of their dead center position as the stair structure is retracted, and means for lowering and raising the panel and extending and retracting the stair structure.

U.S. Pat. No. 2,564,954 to Brelsford discloses a floor, an inclined stair leading up therefrom and having a fixed upper section and a retractable lower section, means to guide the upper end of the lower section along a vertical path. The vertical guide means includes a pair of guide members between which the lower section fits and has confronting vertical slots. The vertical guide means further Include rollers carried by the upper end of the lower section and engaging the slots. Means to guide the lower end of the lower section along a horizontal path extend in opposite directions from the line of movement of the upper end of the lower section. The horizontal guide means include a spaced pair of confronting guide bars and further include rollers carried by the lower end of the lower member and engaging the guide bars, and means to effect movement of the lower end of the lower section along the horizontal path.

U.S. Pat. No. 2,572,281 to Pierce discloses a folding stairway comprising a horizontal frame, a main stair section pivoted at one end to an end of the frame and adapted to be disposed inoperatively within the confines of said frame, a sub-stair section, a pair of parallel arms on each side of said stair sections for pivotally supporting said sub-stair section on the main stair section, a toggle on each side of said frame, each comprising a link pivoted at one end to one side of said main stair section, and an arm pivoted at one end to the opposite end of said link. An eccentric pulley is mounted on each side of the frame, to the shaft of which the opposite end of said latter arm is affixed to move therewith. A primary counter balancing spring is on each side of the frame, the springs have then ends attached to the peripheries of the pulleys and their opposite ends to an end of the frame to exert a lifting force on the stair sections through the eccentric pulleys and the toggle. A pair of secondary counter balancing springs have their upper ends connected to the sides of the twain stair sections and their lower ends to one of the parallel arms and effective to exert a lifting force on said sub-stair section and flexible means for stabilizing the toggle in extended position of the stair sections.

U.S. Pat. No. 2,593,336 to Nixon discloses a collapsible stairway adapted to be positioned in an opening through a floor comprising a stationary step having a tongue extended from the forward edge and a recess in the under surface of the rear edge mounted in the floor and positioned in one end of the opening. Vertically positioned-balusters are carried by the stationary step. A plurality of slidably connected intermediate steps also have over-lapping tongues cm the forward, edges and recesses in the upper surfaces of the rear edges which provide ledges to receive the tongues of adjoining steps. A hand-rail has a plurality of sections with over-lapping tongues on the rear edges and recesses in the upper surfaces of the forward edges which provide ledges to receive the tongues of adjoining sections. Banisters are positioned on the ledges at the rear of the intermediate steps and extend through openings in tongues of upwardly disposed steps and on the upper ends of which the sections of the hand-rail are carried whereby the balusters connect the sections of the hand rail to the steps providing intermediate units of the stairway. An upper hand-rail section is carried by the vertically positioned baluster on the stationary step and has a recess in the upper surface of the forward edge for receiving the tongue of the upper intermediate section of the hand-rail. A relatively extensible stringer is pivotally mounted in the recess in the under surface of the upper stationary step, extended below the intermediate steps and positioned to be engaged by the rear edges of the intermediate steps for supporting the steps with the stairway extended downwardly for use.

U.S. Pat. No. 2,931,456 to Harmon discloses a disappearing stairway structure comprising an open frame adapted to be mounted in a ceiling, a stair way movable between an operative position extending from the frame to the floor below and a substantially horizontal inoperative position adjacent the frame. Means are cooperating between the frame and the stairway for supporting the latter for the movement. A hand rail is carried by the stairway, and guiding means carried by the frame and engage the hand rail in all positions of the stairway for guiding it for movement between the operative and inoperative positions.

U.S. Pat. No. 3,985,202 to Harmon discloses a unitary stairway (as distinguished from a sectional folding stairway) is adapted to assume an inclined operative position and an upper horizontal inoperative position above the ceiling of the room. Hydraulic means imparts longitudinal forces to the stairway to move it upwardly or downwardly, and rails carried by the stairway are engageable in guide rollers to guide the stairway between operative and inoperative positions. A wall switch is operable to energize a motor for driving a pump to generate power in the hydraulic means.

U.S. Pat. No. 5,111,906 to Abadia discloses a retractable ladder apparatus (30) for access between a lower and an upper floor is provided. A ladder (60) is moved by moving means, which may be a garage door opener (40), between a position of storage within the upper floor to a position where the lower end of the ladder abuts the lower floor.

U.S. Pat. No. 5,626,440 to Greene, Jr., et al. discloses a stairway for providing access over a dune to a beach, while being retractable to avoid damage from adverse weather conditions, the stairway being adapted to be mounted on a plurality of piling on a dune, the stairway comprising a pivotally mounted housing section having an upper surface suitable for use as a walkway and a cavity beneath the walkway; a stair section moveable between a retracted position within the housing section cavity and an extended position, wherein the stair section extends from the housing section to the beach at an angle of about 45.degree below horizontal; and drive means adapted to move the stair section between retracted and extended positions.

U.S. Pat. No. 6,739,100 to Lewandowski discloses a stairwell cover adapted to seal a stairwell opening such as between a first floor living space and a basement when the basement is not in use includes a housing mounted to a wall partition above the base of the stairs, a retractable cover rotatably mounted in the housing, and a pair of roller rails extending along the sidewalls of the stairwell and along which the cover rolls for movement between an retracted position providing open access to the basement and an extended position closing off the basement at the top of the stairwell.

U.S. Pat. No. 6,802,392 to Davis discloses a stair is pivotable from a lowered position allowing a user to climb the stair from a lower level to an upper level, into a stowed position wherein the stair is lifted from the lower level so that the plane of the stair is approaches the ceiling situated between the lower and upper level. The stair, which is preferably not articulated (i.e., the stair does not fold), rotates between the lowered and stowed positions about a pivot fixed in association with the ceiling. A drive cable, which preferably extends from the stair top or from a drive arm extending from the stair top, is anchored to surrounding structure in the upper level. A drive motor drives the drive cable to draw the stair top downwardly, thereby raising the stair bottom about the pivot.

U.S. Pat. No. 6,866,118 to Battenberg discloses a ladder apparatus for providing, access to an area over an elevated structure, the ladder apparatus including a housing secured to the elevated structure; a ladder pivotally mounted to the housing, the ladder means including an upper ladder section and at least one lower ladder section mounted to the upper ladder section; and a motorized deploying mechanism structured to controllably allow the ladder apparatus to be pivotally and gravitationally deployed from a stowed configuration to a partially deployed configuration, controllably allow the at least one lower ladder section to be longitudinally and gravitationally deployed from the partially deployed configuration to a fully deployed configuration, longitudinally retract the at least one lower ladder section from the fully deployed configuration to the partially deployed configuration, and pivotally retract the ladder apparatus from the partially deployed configuration to the stowed configuration. A control t mechanism operatively controls the motorized deploying mechanism. A power source provides electrical energy to the motorized deploying mechanism and to the control mechanism.

U.S. Pat. No. 6,886,661 to Battenberg discloses a ladder apparatus for providing access to an area over an elevated structure, the ladder apparatus including a housing secured to the elevated structure wherein the housing includes a housing mechanism having a central opening, a ladder pivotally mounted to the housing mechanism wherein the ladder includes a first ladder section and at least one additional ladder section slidingly mounted to the first ladder section, first motorized deploying mechanism structured to pivotally displace the ladder to and from a stored configuration and a partially deployed configuration, second motorized deploying mechanism structured to linearly displace the at least one additional ladder section to and from a partially deployed configuration and a fully deployed configuration; and control mechanism structured to operatively control the first and second motorized deploying mechanism.

U.S. Pat. No. 8,028,804 to Lair discloses an access panel is shown in the present invention to provide easy and safe access to an attic space or elevated structure. The access panel is fully automatic. During opening, the access panel uses an energizing motor to control the gravitational forces for opening a cover and deploying ladder sections. During closing, the access panel is energized to retract the ladder sections and close the access panel. The motor is energized to close the access panel until a stow latch engages to stow the access panel during non-use. A safety switch is mounted inside the attic space to allow a user to open the panel and extend the ladder should the user be trapped in the attic space.

U.S. Patent Application 20070181364 to Lair discloses an access panel is shown in the present invention to provide easy and safe access to an attic space or elevated structure. The access panel is fully automatic. During opening, the access panel only uses gravitational forces for opening a cover. Only during closing is the access panel motorized. The gravitational forces are used to both open the cover and extend the ladder sections, while the motor is only used to retract the latter sections and close the covert stow latch keeps the cover closed during non-use. A safety switch keeps the access panel from accidentally opening and the ladder sections from lowering if the stow latch is released. A mechanical lock keeps the cover open when the ladder sections have been lowered.

U.S. Patent Application 20090255757 to Burke discloses a folding attic stair assembly comprises a rectangular outer mounting frame. An inner stairway carrying frame is mounted by a hinge at one end of the outer mounting frame for movement between a raised stored position on the outer mounting frame and a lowered position extending downwardly from the mounting frame. An extendable attic, stair is mounted on the inner frame. A pair of folding support arms extend between the outer mounting frame and the inner stairway carrying frame. A cable connects between each folding support arm and an associated reel mounted on a drive shaft which is connected to a drive motor. This drive motor is operable to wind and unwind the cables on the reels to raise and lower the attic stair in a controlled manner.

U.S. Patent Application 20120199417 to Richey; et al. discloses a remote controlled overhead ladder system including a ladder structure having at least a first section and a second section. The ladder structure can be mounted to a support structure located above an opening of the overhead surface, and can include a remote controlled lifting cable connected to the first and second sections such that upon receipt of a remote control signal, the lifting cable pivots the second section toward a front surface of the first section until the second section is oriented adjacent to the front surface of the first section, at which time the lifting cable pivots the first section and the adjacent second section as a group toward the overhead surface until the ladder sections are contained above the overhead surface.

Although the aforementioned prior art have contributed to the development of the art of staircases for transitioning an individual or object from a lower elevation to an upper elevation none of these prior art patents have solved the needs of this art.

Therefore, it is an object of the present invention to provide an improved retracting staircase.

Another object of this invention is to provide an improved retracting staircase that is easily positioned between a storage position and a utilizing position.

Another object of this invention is to provide an improved retracting staircase that will improve the safety of an individual traversing the staircase.

Another object of this invention is to provide an improved retracting staircase that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to a retractable staircase for ascending and descending between a lower elevation and an upper elevation. The lower elevation has a lower surface and the upper elevation has an upper surface. The retractable staircase comprises a main frame having a primary side, a secondary side and extending between a proximal end and a distal end. A frame pivot pivotably couples the proximal end of the main frame to the upper surface. A staircase has a primary side, a secondary side and extends between a pro mal end and a distal end. A plurality of hearings slidably couple the staircase to the main frame. A drive is supported above the upper surface. A tether is coupled to the drive and the staircase. The drive causes a first lifting displacement the staircase and the main frame for reducing the length of the tether and distancing the staircase from the lower surface. The first lifting displacement defines an ascending compound displacement by simultaneously causing an ascending staircase pivot displacement and an ascending frame pivot displacement relative to the frame pivot and causing an ascending slide displacement of the staircase relative to the main frame. The drive causes a second displacement the staircase and the main frame for reducing the length of the tether and distancing the staircase from the lower surface. The second lifting displacement is defined by a lower stop engaging between the main frame and the staircase and terminating the ascending slide displacement of the staircase relative to the main frame and permitting only the ascending staircase pivot displacement and the ascending frame pivot displacement. The drive causes a retracted length in the tether for maintaining the staircase and the main frame in a generally parallel orientation with the upper surface. The drive causes a first descending displacement in the staircase and the main frame for increasing the length of the tether and distancing the staircase from the upper surface. The first descending displacement is defined by the lower stop engaging between the main frame and the staircase and preventing a descending slide displacement of the staircase relative to the main frame and permitting only a descending staircase pivot displacement and a descending frame pivot displacement. The drive causes a second descending displacement in the staircase for increasing the length of the tether and distancing the staircase from the upper surface. The second descending displacement defines a descending compound displacement by simultaneously causing the descending staircase pivot displacement and the descending frame pivot displacement relative to the frame pivot and causing the descending slide displacement of the staircase relative to the main frame. The drive causes an extended length in the tether for positioning the staircase in a generally adjacent orientation with the lower surface.

In one embodiment of the invention the drive causes a third descending displacement in the staircase for increasing the length of the tether and distancing the staircase from the upper surface. The third descending displacement is defined by an upper stop engaging between the main frame and the staircase and terminating the descending slide displacement of the staircase relative to the main frame and permitting only the descending staircase pivot displacement and the descending frame pivot displacement.

In another embodiment of the invention a door cover has a primary side, a secondary side and extending between a proximal end and a distal end. A door cover pivot pivotably couples the proximal end of the door cover to the upper surface. A sliding link couples the door cover to the main frame. The door cover covers the main frame and the staircase during the retracted length in the tether and the staircase in the generally parallel orientation with the upper surface.

The invention is also incorporated into the method for ascending and descending a retractable staircase between a lower elevation and an upper elevation, the lower elevation having a lower surface and the upper elevation having an upper surface. The method comprising the steps of displacing a staircase and a main frame and causing a first lifting displacement in a staircase and a main frame for reducing the length of a tether and distancing the staircase from the lower surface wherein the first lifting displacement defining an ascending compound displacement by simultaneously causing an ascending staircase pivot displacement and an ascending frame pivot displacement relative to the frame pivot and causing an ascending slide displacement of the staircase relative to the main frame. The staircase and the main frame are further displaced and cause a second lifting displacement in the staircase and the main frame for reducing the length of the tether and distancing the staircase from the lower surface wherein the second lifting displacement defined by a lower stop engaging between the main frame and the staircase and terminating the ascending slide displacement of the staircase relative to the main frame and permitting only the ascending staircase pivot displacement and the ascending frame pivot displacement. The staircase and the main frame are positioned and are maintained in a generally parallel orientation with the upper surface. The staircase and the main frame are displaced and cause a first descending displacement in the staircase and the main frame for increasing the length of the tether and distancing the staircase from the upper surface wherein the first descending displacement defined by the lower stop engaging between the main frame and the staircase and preventing a descending slide displacement of the staircase relative to the main frame and permitting only a descending staircase pivot displacement and a descending frame pivot, displacement. The staircase and the main frame are displaced and causing a second descending displacement in the staircase for increasing the length of the tether and distancing the staircase from the upper surface wherein the second descending displacement defining a descending compound displacement by simultaneously causing the descending staircase pivot displacement and the descending frame pivot displacement relative to the frame pivot and causing the descending slide displacement of the staircase relative to the main frame. The staircase is positioned and maintained in a generally adjacent orientation with the lower surface.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
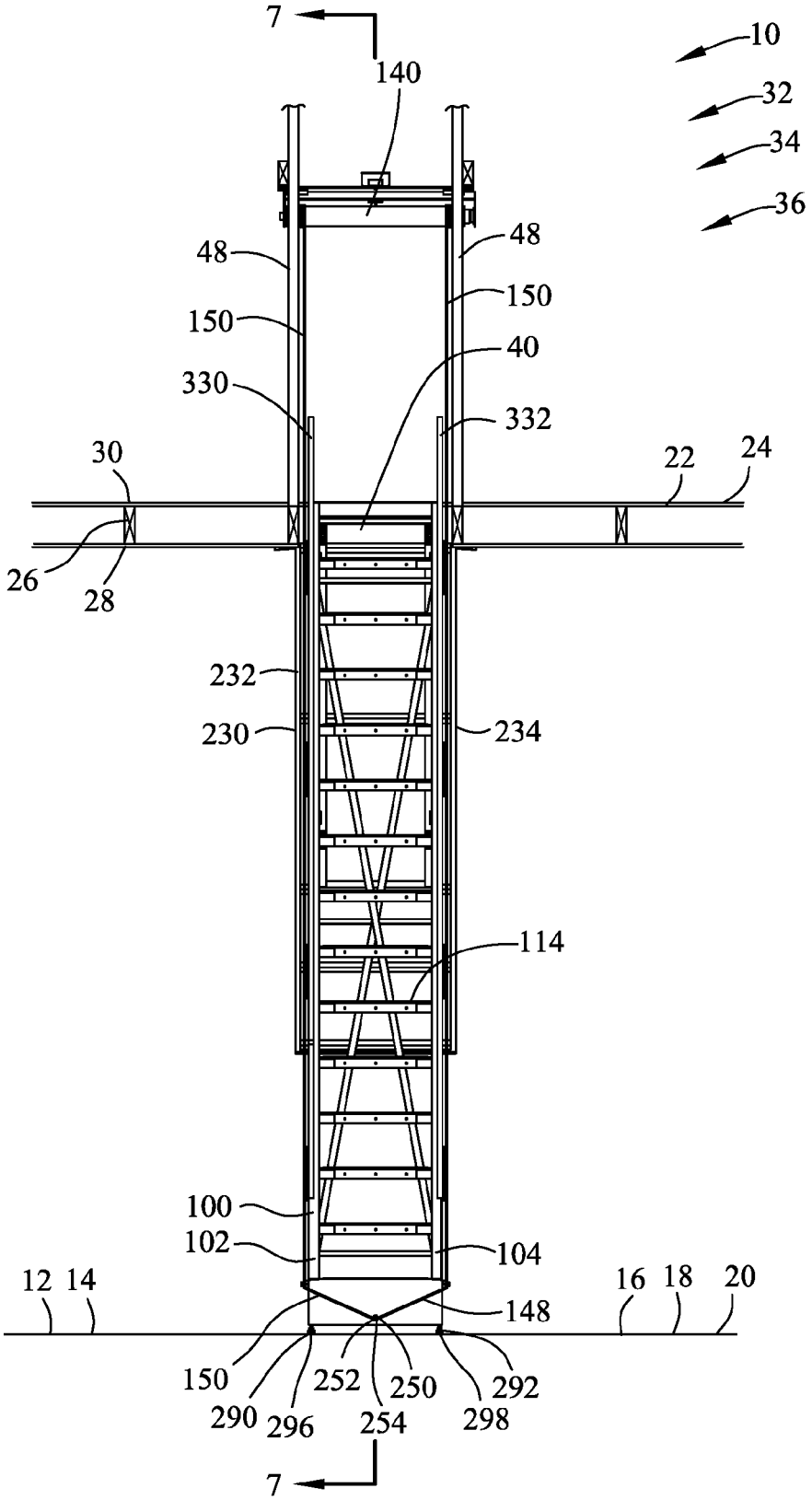
FIG. 1 is a front view of a retractable staircase position adjacent to a lower surface.
Figure 2:
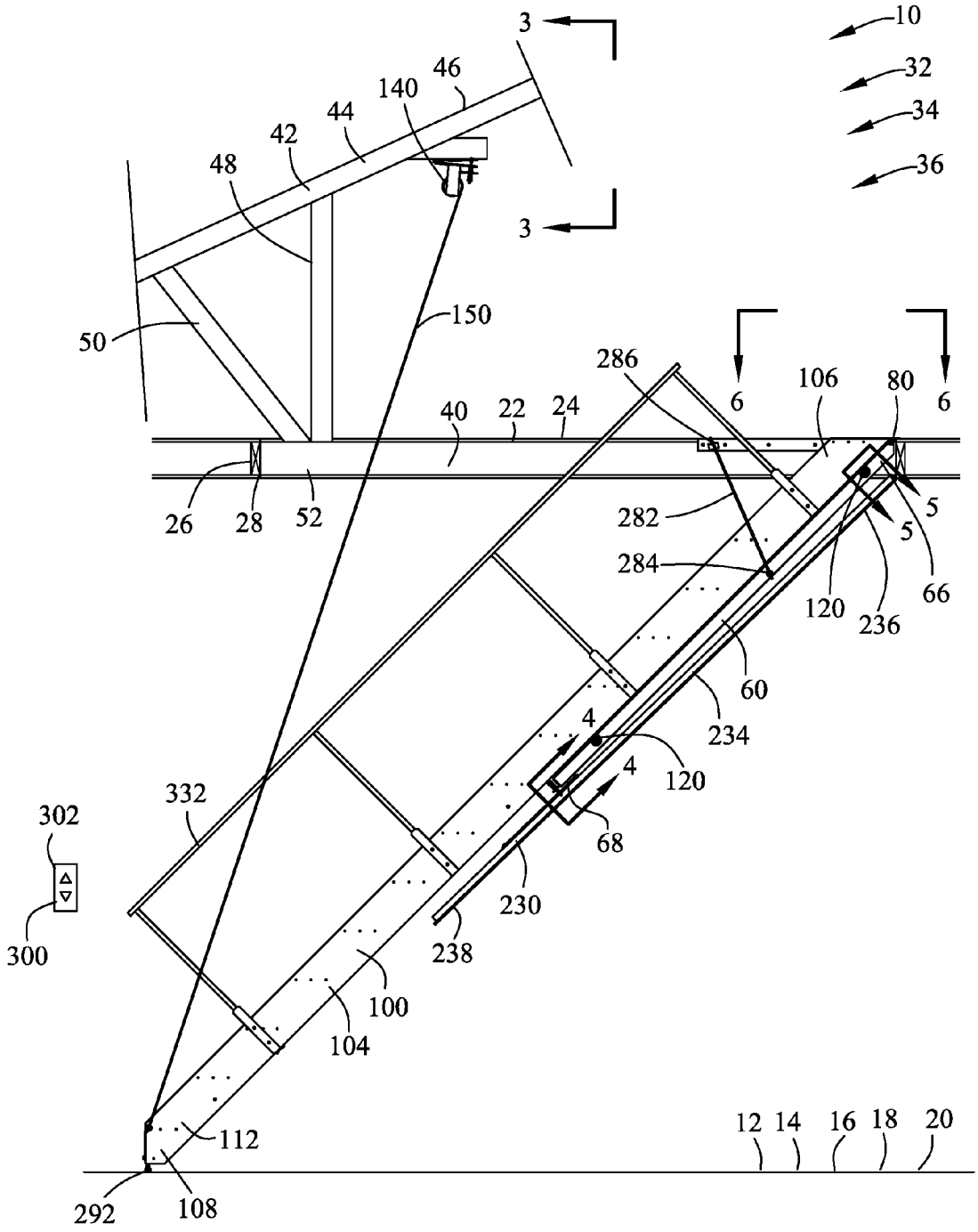
FIG. 2 is a tight side view of FIG. 1, illustrating the retractable staircase in a structure for ascending into an attic.
Figure 3:
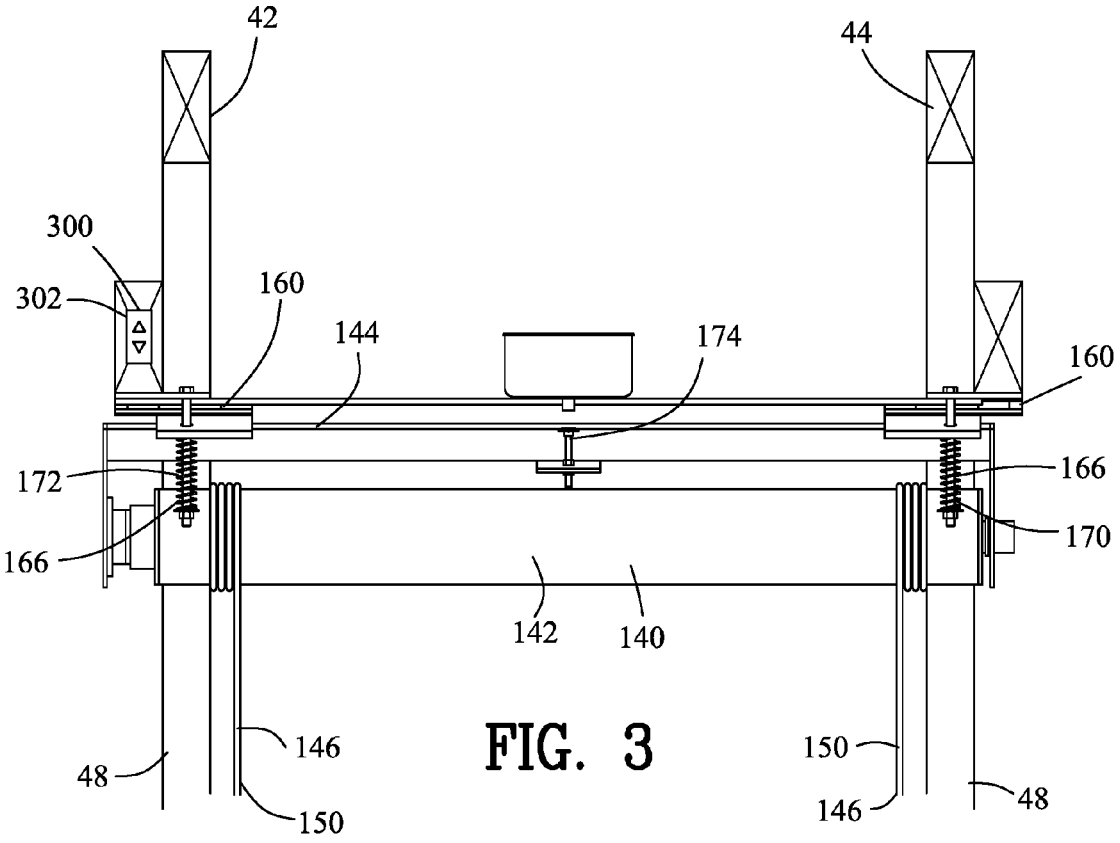
FIG. 3 is a sectional view alone line 3-3 in FIG. 2, illustrating a tubular motor in a lower motor position.

FIGS. 1-20 illustrate a retractable staircase 10 for ascending and descending between a lower elevation 12 and an upper elevation 22. The lower elevation 12 has a lower surface 14 and the upper elevation 22 has an upper surface 24. The retractable staircase 10 may be utilized in a commercial building, a residential building, a storage facility, or other structure. As such, the lower surface 14 may include a garage floor 16, an office floor 18, a residence floor 20. Furthermore, the upper elevation 22 may include an attic 32, a second office area 34, a second residence area 36. FIGS. 1-20 illustrate the retractable staircase 10 secured within an upper surface aperture 40 positioned within a floor joist 26. The floor joist 26 includes a lower floor joist surface 28 and an upper floor joist surface 30. A truss 42 includes a bottom chord 52, a diagonal web 50, a vertical web 48 and a top chord 44 for supporting a roof 46.

The retractable staircase 10 is to be positioned within the upper surface aperture 40. In many instances in order to install the retractable staircase 10 within the upper surface aperture 40, the upper surface aperture 40 may required enlarging. For example, a standard upper surface aperture 40 may include the dimensions of 22.5"×54". The upper surface aperture 40 may be enlarged to 95.5"×22.5" or 114.5"× 22.5".

The retractable staircase 10 comprises a main frame 60 having a primary side 62, a secondary side 64 and extending between a proximal end 66 and a distal end 68. The main frame 60 may include one or more cross members 70. The main frame 60 may be constructed of metallic material, polymeric material or other rigid materials.

A frame pivot 80 pivotably couples the proximal end 66 of the main frame 60 to the upper surface 24. More specifically, the frame pivot 80 is positioned on the upper floor joist surface 30 of the upper surface 24.

A staircase 100 has a primary side 102, a secondary side 104 and extends between a proximal end 106 and a distal end 108. The staircase 100 is preferably constructed from a primary generally C-shaped channel 110, a secondary generally C-shaped channel 112 and a plurality of tread boards 114 extending there between. A C-shaped tread mounting channel 116 may be utilized for coupling the plurality of tread boards 114 to the primary generally C-shaped channel 110, a secondary generally C-shaped channel 112. Fasteners and/or epoxy 118 may couple the C-shaped tread mounting channel 116 to the primary generally C-shaped channel 110 and a secondary generally C-shaped channel 112. The staircase 100 may be constructed of metallic material, polymeric material or other rigid materials.

A plurality of bearings 120 slidably couple the staircase 100 to the main frame 60. The plurality of bearings 120 may include a plurality of primary interior rollers 122 coupled to the main frame 60 and rolling against the interior of the primary generally C-shaped channel 110, a plurality of primary exterior rollers 124 coupled to the main frame 60 and rolling against the exterior of the primary generally C-shaped channel 110, a plurality of secondary interior rollers 126 coupled to the main frame 60 and rolling against the interior of the secondary generally C-shaped channel 112, and a plurality of secondary exterior rollers 128 coupled to the main frame 60 and rolling against the exterior of the secondary generally C-shaped channel 112.

Figure 5:
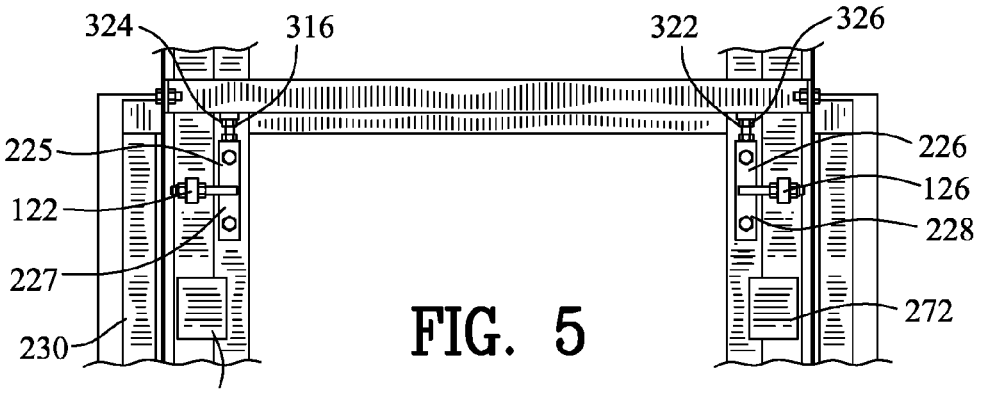
FIG. 5 is a sectional view along line 5-5 in FIG. 2, illustrating a primary upper stop and a secondary upper stop.
Figure 5A:
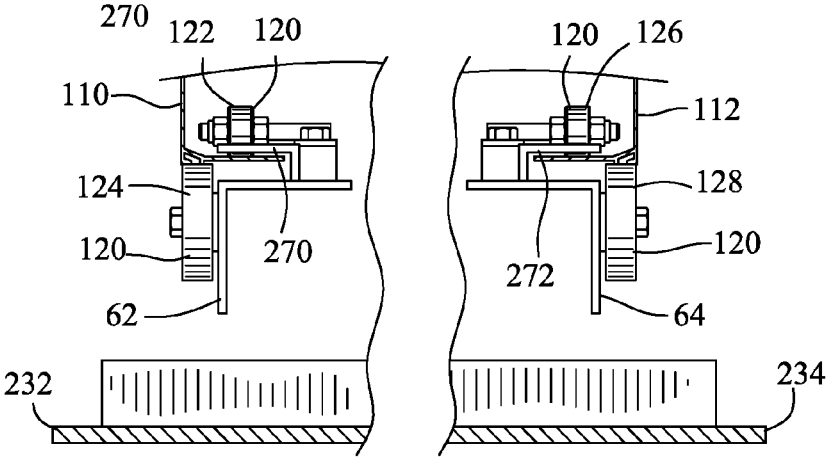
FIG. 5A is an enlarged front view of portions of FIG. 5.
Figure 6:
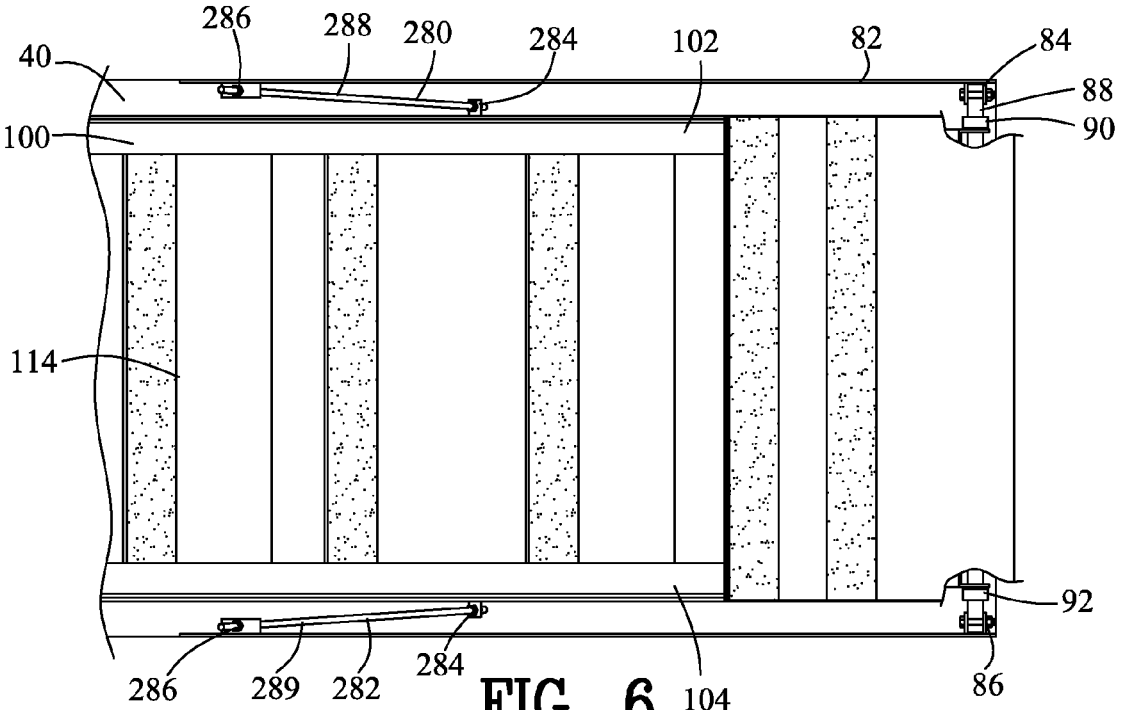
FIG. 6 is a view alone line 6-6 in FIG. 2.

As best shown in FIG. 5A, the retractable staircase 10 may include a plurality of primary generally L-shaped brackets 270 coupled to the primary side 62 of the main frame 60 and positioned adjacent to the interior of the primary generally C-shaped channel 110. A plurality of secondary generally L-shaped brackets 272 may be coupled to the secondary side 64 of the main frame 60 and positioned adjacent to the interior of the secondary generally C-shaped channel 112. The plurality of primary generally L-shaped brackets 270 and the plurality of secondary generally L-shaped brackets 272 assist in preventing the staircase 100 from decoupling from the main frame 60. For example, if an obstruction object 262 were to become between the retractable staircase 10 and the upper surface 24 during ascending of the retractable staircase 10, may cause the staircase 100 to dislodge from the main frame 60. More specifically, the plurality of bearings 120 may become dislodged. The plurality of primary generally L-shaped brackets 270 and the plurality of secondary generally L-shaped brackets 272 define a safety feature in that in the event the plurality of bearings 120 may become dislodged, the plurality of primary generally L-shaped brackets 270 and the plurality of secondary generally L-shaped brackets 272 will prevent the staircase 100 from disengaging from the mainframe 60.

A drive 140 is supported above the upper surface 24. More specifically, the dive 140 may be secured to the top chord 44. Additional framing may be required to couple the dive 140 to the upper surface 24. The drive 140 may include a tubular motor 142 rotatably coupled to a motor mounting bracket 144. The drive 140 may be controlled by an electrical circuit 300 that may include a wireless remote 302. The tubular motor 142 may further include a smart or programmable function for programming the lower position and the upper position of the retractable staircase 10 into a memory. The tubular motor 142 may include a radio controlled awning motor. A safety button may be electrically coupled to the dive 140. The safety button may be installed within the upper elevation for activating the dive 140 and lowering the staircase 100 if someone is inadvertently closed into the upper elevation 22.

Preferably, the drive 140 is positioned between 42 inches to 46 inches above the upper surface aperture 40. In addition, the drive 140 is preferably positioned such that the location of the drive 140 is displaced horizontally between 20 inches to 32 inches from the non-pivoting edge of the upper surface aperture 40. If the upper elevation 22 has a very lower vertical clearance height, the drive 140 is preferably located closer to the horizontal displacement of 20 inches for reducing the inserting dimension of the proximal end 106 of the staircase 100 of both the upper surface 24 and into the upper elevation 22. This may be required wherein the retractable staircase 10 is utilized in an office or residence with a low pitched roof.

A tether 146 is coupled between the drive 140 and the staircase 100. The tether 146 may include a metallic cable, polymer cable, Teflon cable or other flexible elongated members 150. The tether 146 may include a tether loop 148 wherein the two ends engage the tubular motor 142. The tether 146 spirals about the tubular motor 142 for reducing the length of the tether 146 and distancing the staircase 100 from the lower surface 14. Alternatively, the tether 146 un-spirals about the tubular motor 142 for increasing the length of the tether 146 and distancing the staircase 100 from the upper surface 24.

Figure 12:
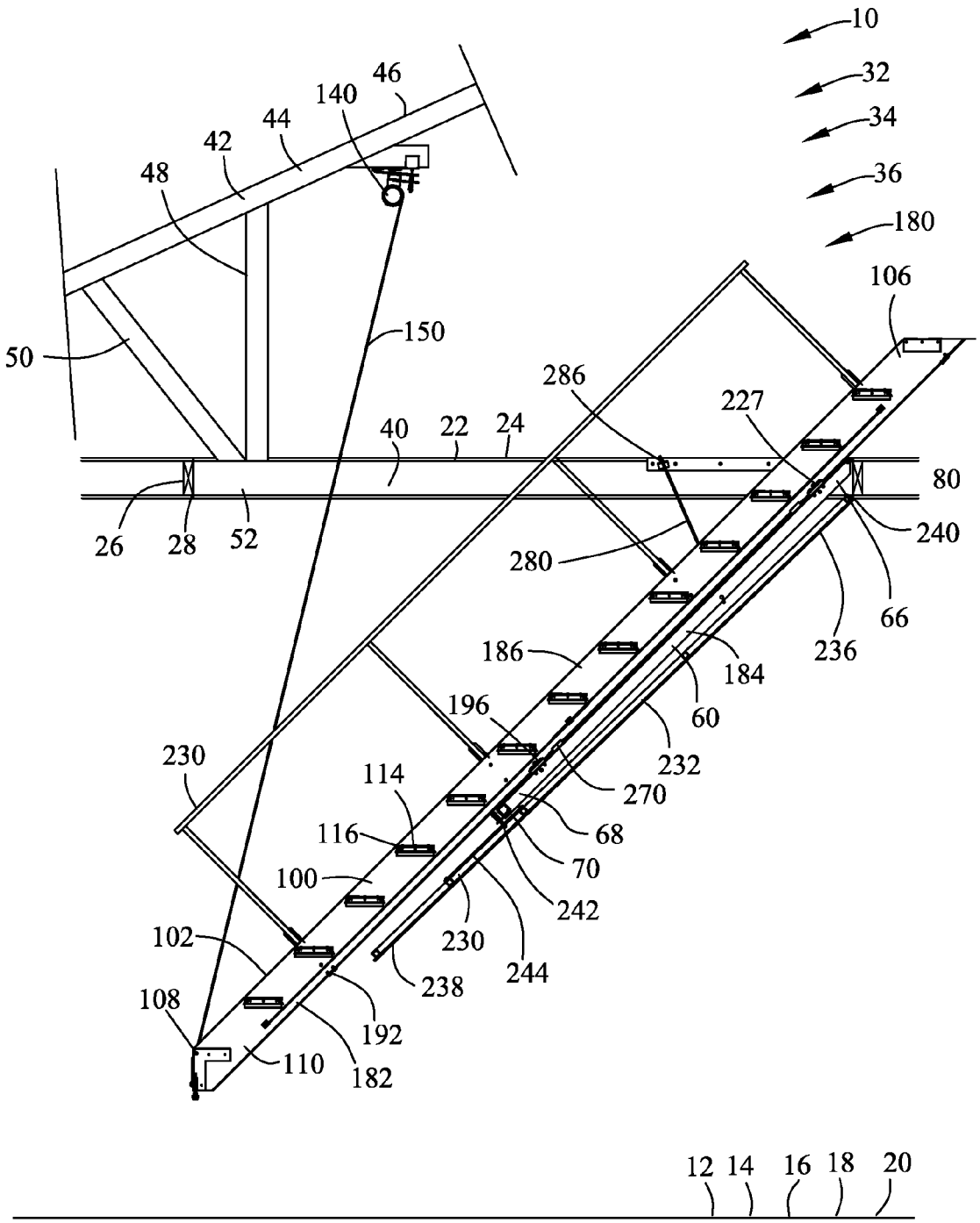
FIG. 12 is a view similar to FIG. 7 illustrating either a first lifting displacement having an ascending compound displacement including a pivoting displacement and a sliding displacement or a continued second descending, displacement having a descending compound displacement including a pivoting displacement and a sliding displacement.
Figures 13, 14:
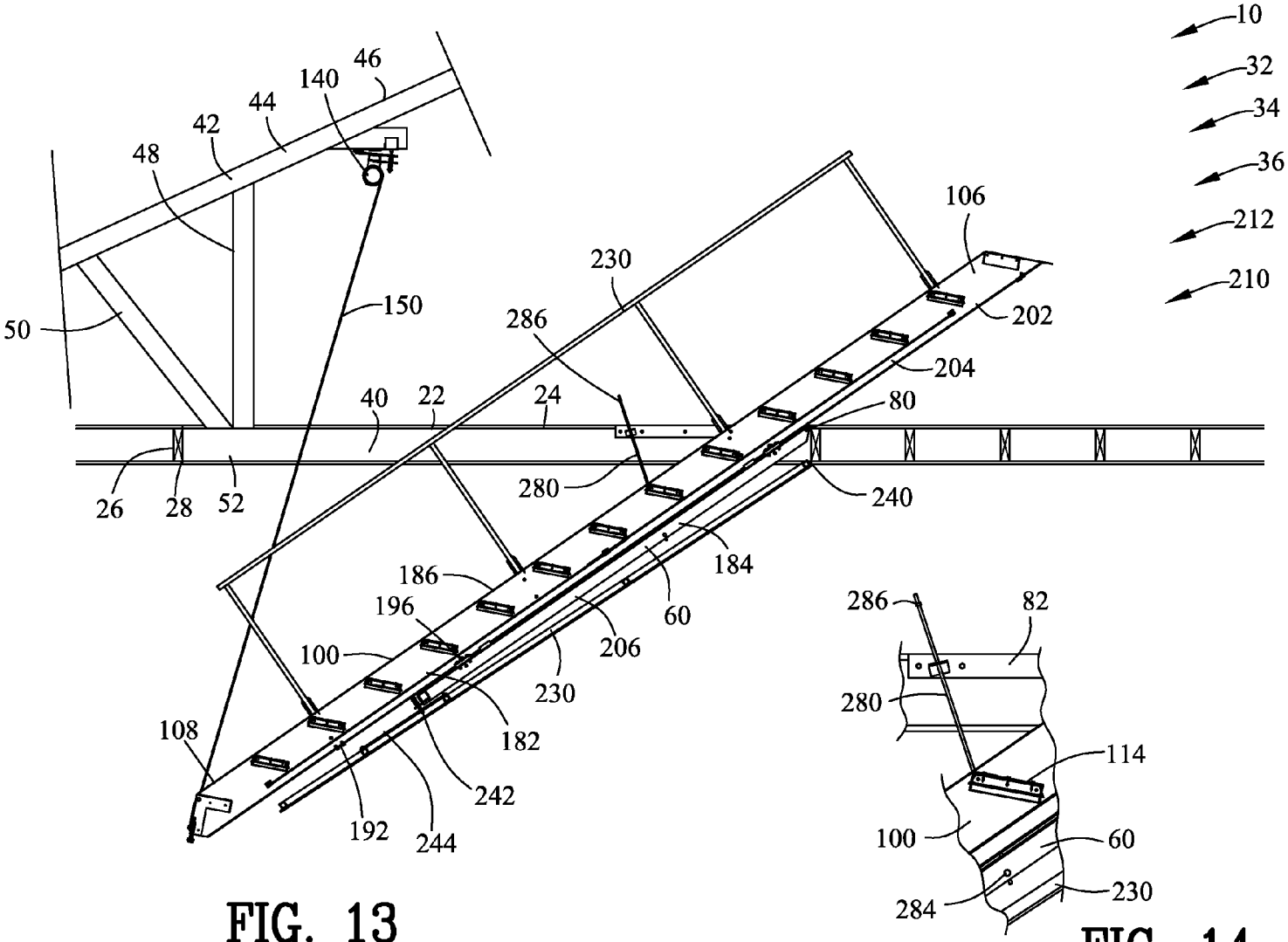
FIG. 13 is a view similar to FIG. 12 illustrating either the continued first lifting displacement having an ascending compound displacement or a second descending displacement having a descending compound displacement including a pivoting displacement and a sliding displacement.
FIG. 14 is an enlarged view of a portion of FIG. 13 illustrating a hanger rod extending from a generally U-shape mounting bracket to the staircase.

As shown in FIGS. 12 and 13 the drive 140 causes a first lifting displacement 180 in the staircase 100 and the main frame 60 for reducing the length of the tether 146 and distancing the staircase 100 from the lower surface 14. The first lifting displacement 180 defines an ascending compound displacement by simultaneously causing an ascending staircase pivot displacement 182 and an ascending frame pivot displacement 184 relative to the frame pivot 80 and causing an ascending slide displacement 186 of the staircase 100 relative to the main frame 60. The ascending compound displacement including the ascending staircase pivot displacement 182, the ascending frame pivot displacement 184 and the ascending slide displacement 186 requires less clearance space above the upper surface 24.

Figure 15:
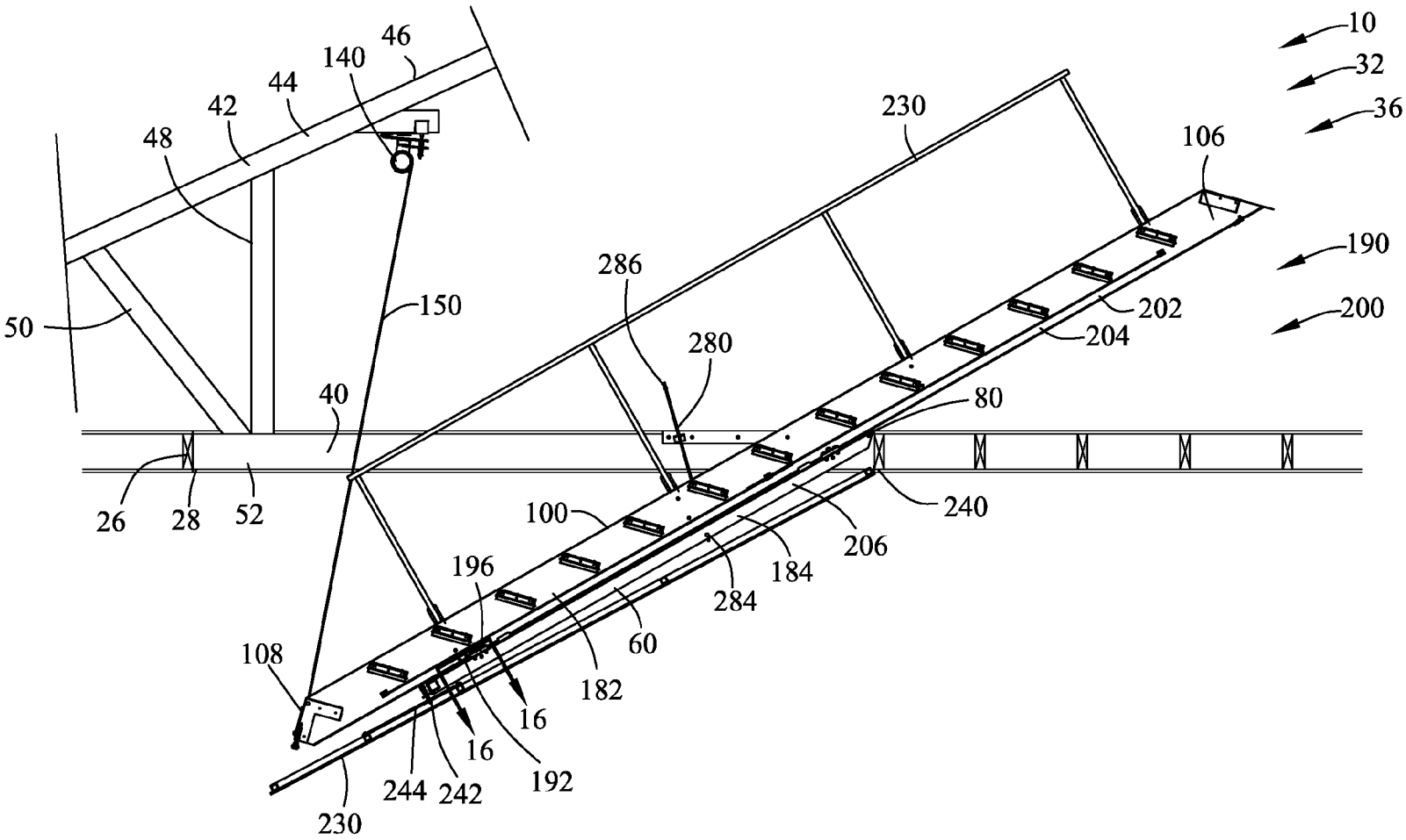
FIG. 15 is a view similar to FIG. 12 illustrating either a second lifting displacement or a first descending displacement having only a sliding displacement.
Figure 16:
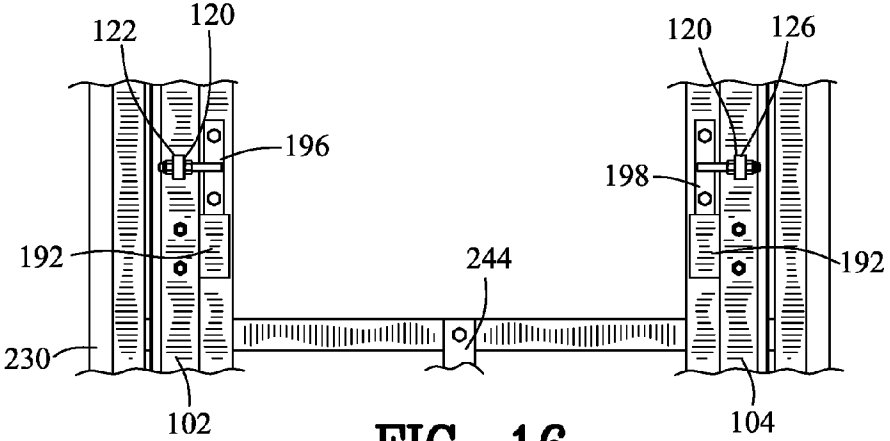
FIG. 16 is a sectional view along line 16-16 in FIG. 15 illustrating a lower stop engaging for terminating an ascending slide displacement.

As shown in FIG. 15, the drive 140 causes a second lifting displacement. 190 in the staircase 100 and the main frame 60 for reducing the length of the tether 146 and distancing the staircase 100 from the lower surface 14. The second lifting displacement 190 is defined or occurs upon a lower stop 192 engaging between the main frame 60 and the staircase 100 and thereafter terminates the ascending slide displacement 186 of the staircase 100 relative to the main frame 60 and permits only the ascending staircase pivot displacement 182 and the ascending frame pivot displacement 184. As shown in FIG. 16, the lower stop 192 may be coupled to the staircase 100 and engage a lower primary stop block 196 and a lower secondary stop block 198 coupled to the main frame 60. The second lifting displacement 190 requires less clearance space above the upper surface 24.

Figure 17:
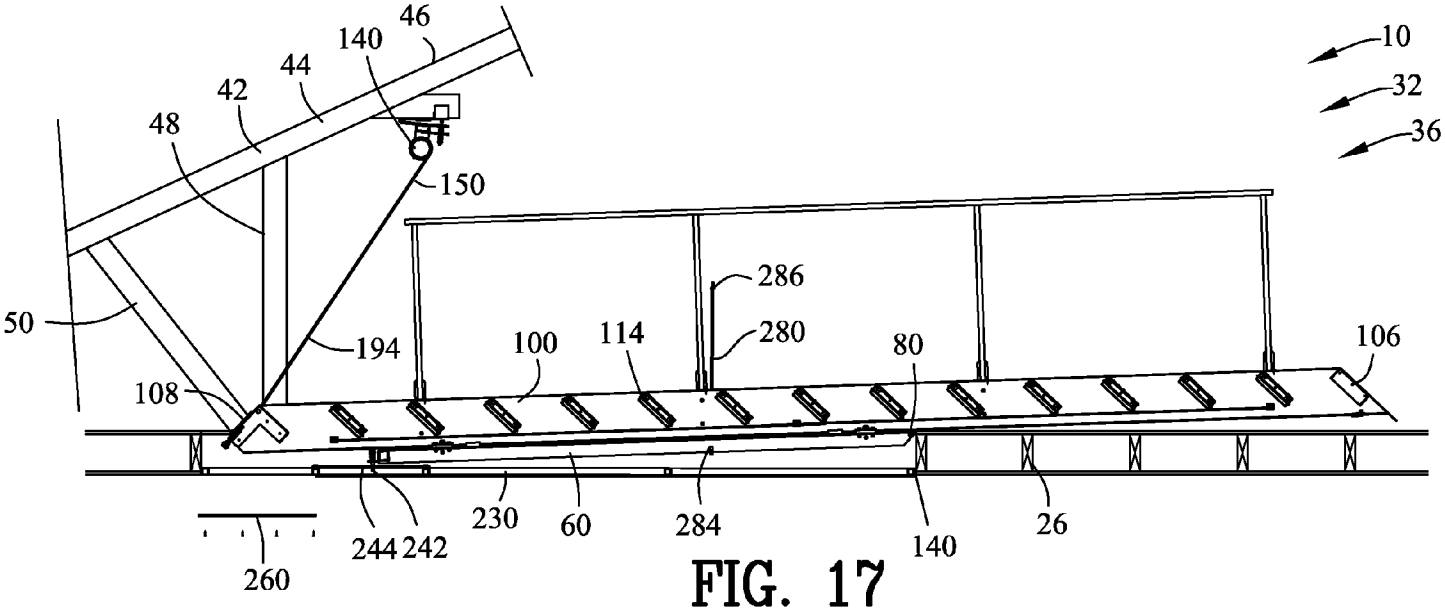
FIG. 17 is a view similar to FIG. 15 illustrating the staircase in a generally adjacent orientation with the lower surface.

As shown in FIG. 17 the drive 140 causes a retracted length 194 in the tether 146 for maintaining the staircase 100 and the main frame 60 in a generally parallel orientation with the upper surface 24.

The process for ascending the staircase 100 and the main frame 60 are reversed for lowering the staircase 100 and the main frame 60 to the lower surface 14. The tubular motor 142 rotates in the opposite direction and gravity assists in lowering the retractable staircase 10. More specifically, FIGS. 17 to 15, the drive 140 causes a first descending displacement 200 in the staircase 100 and the main frame 60 for increasing the length of the tether 146 and distancing the staircase 100 from the upper surface 24. The first descending displacement 200 is defined by the lower stop 192 engaging between the main frame 60 and the staircase 100 and preventing a descending slide displacement 202 of the staircase 100 relative to the main frame 60 and permitting only a descending staircase pivot displacement 204 and a descending frame pivot displacement 206.

FIGS. 13 to 12 illustrate the drive 140 causing a second descending displacement 210 in the staircase 100 for increasing the length of the tether 146 and distancing the staircase 100 from the upper surface 24. The second descending displacement 210 defines a descending compound displacement 212 by simultaneously causing the descending staircase pivot displacement 204 and the descending frame pivot displacement 206 relative to the frame pivot 80 and causing the descending slide displacement 202 of the staircase 100 relative to the main frame 60. The drive 140 causes an extended length 224 in the tether 146 for positioning the staircase 100 in a generally adjacent orientation with the tower surface 14.

Figure 7:
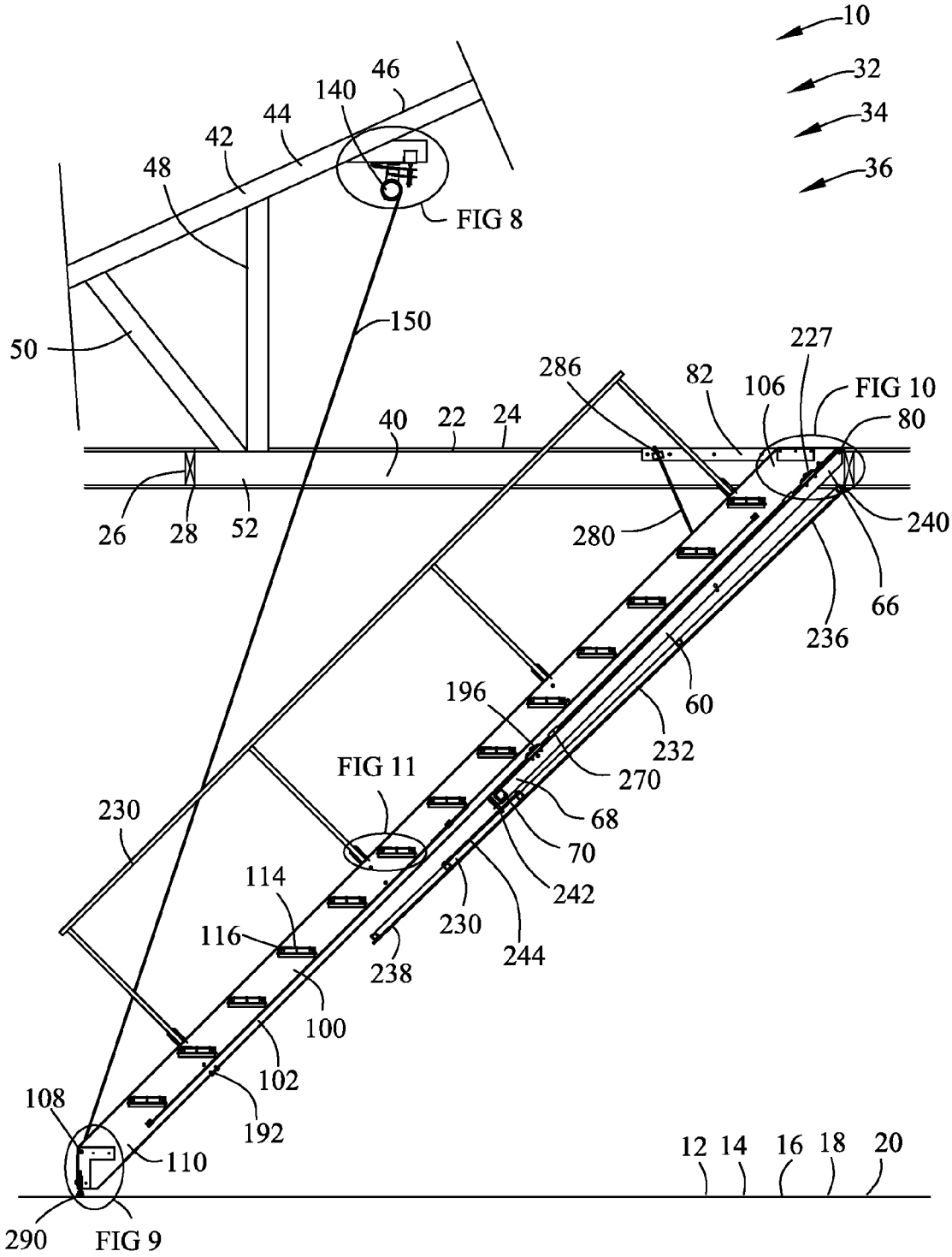
FIG. 7 is a sectional view along line 7-7 in FIG. 1.
Figure 8:
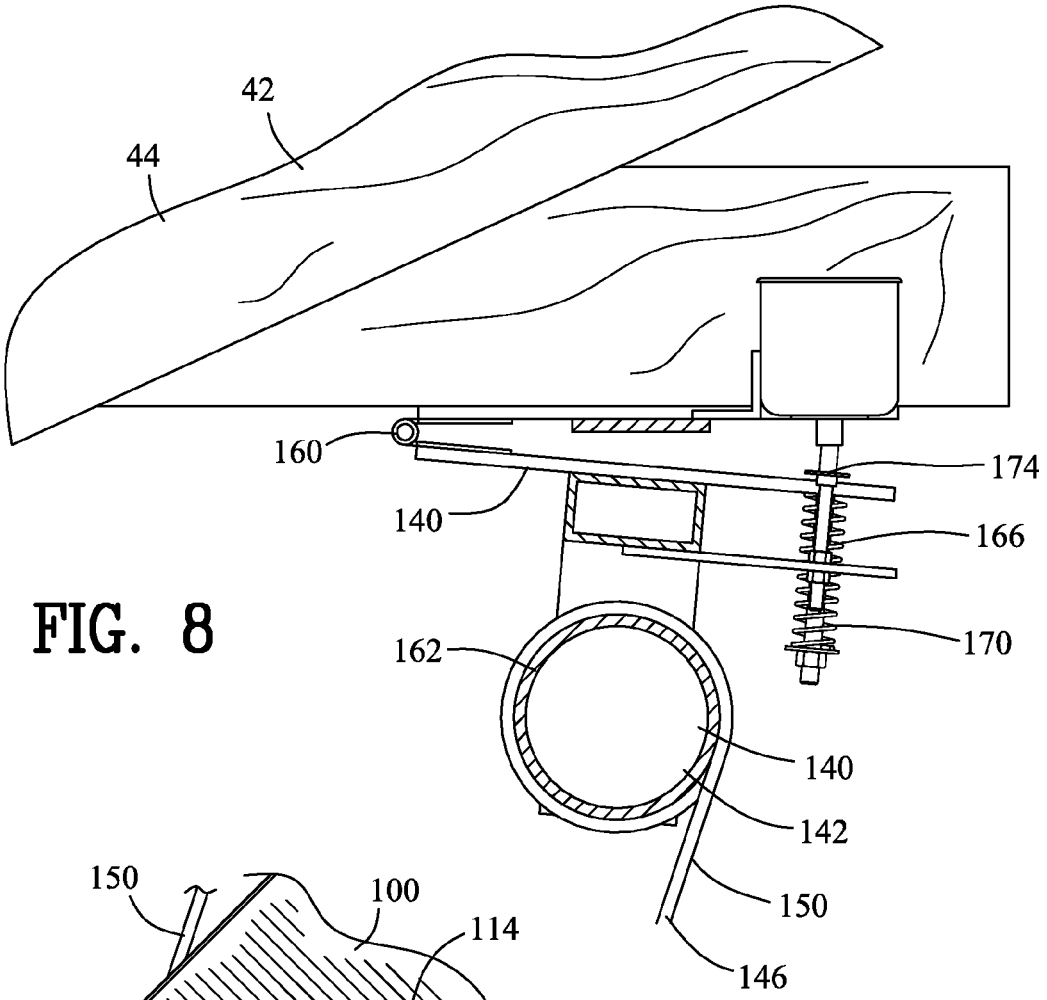
FIG. 8 is an enlarged view of a portion of FIG. 7, illustrating the tubular motor in a lower motor position.

FIG. 7 illustrates the drive 140 causing a third descending displacement 220 in the staircase 100 for increasing the length of the tether 146 and distancing the staircase 100 from the upper surface 24. The third descending displacement 220 is defined by an upper stop 222 engaging between the main frame 60 and the staircase 100 and terminating the descending slide displacement 202 of the staircase 100 relative to the main frame 60 and permitting only the descending staircase pivot displacement 204 and the descending frame pivot displacement 206.

Figure 10:
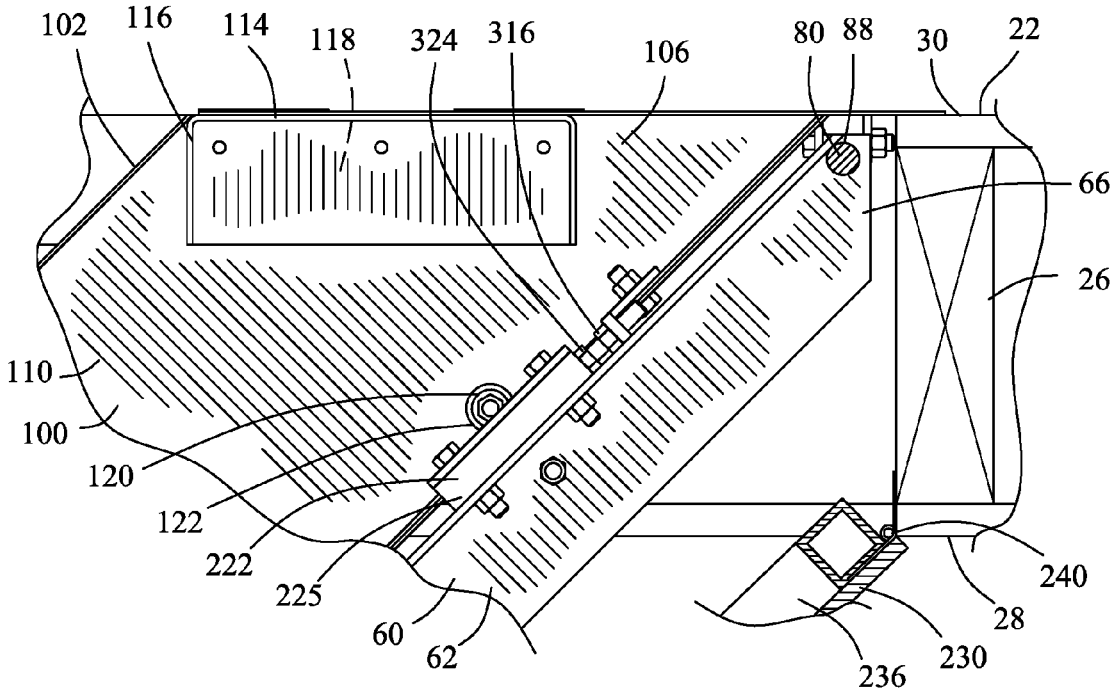
FIG. 10 is an enlarged view of a portion of FIG. 7.
Figure 11:
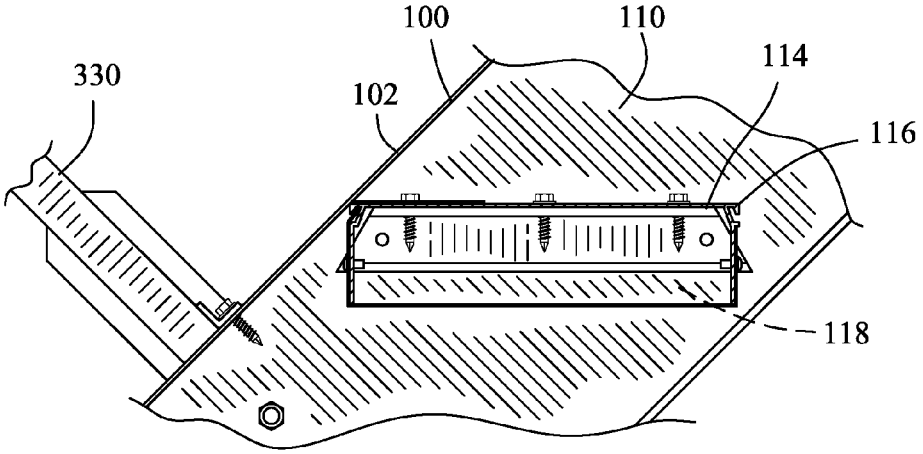
FIG. 11 is an enlarged view of a portion of FIG. 7.

As shown in FIGS. 5 and 10, the upper stop 222 includes a primary stop 225 and a secondary stop 226. The primary stop 225 includes a primary stopping block 227 coupled to the primary side 62 of the main frame 60 and a first threaded rod 316 coupled to the primary side 102 of the staircase 100. The secondary stop 226 includes a secondary stopping block 228 coupled to the secondary side 64 of the main frame 60 and a second threaded rod 322 coupled to the secondary side 104 of the staircase 100. A first threaded rod length adjustment 324 and a second threaded rod length adjustment 326 are in the first threaded rod 316 and the second threaded rod 322 respectively, for adjusting the upper stop 222 dimension of the staircase 100 relative to the main frame 60 and adjusting the angle of the staircase 100 in the generally adjacent orientation with the lower surface 14.

The retractable staircase 10 may include a door cover 230 having a primary side 232, a secondary side 234 and extending between a proximal end 236 and a distal end 238. A door cover pivot 240 pivotably couples the proximal end 236 of the door cover 230 to the upper surface 24. A sliding link 242 couples the door cover 230 to the main frame 60. The door cover 230 covers the main frame 60 and the staircase 100 during the retracted length 194 in the tether 146 and the staircase 100 in the generally parallel orientation with the upper surface 24.

Figure 4:
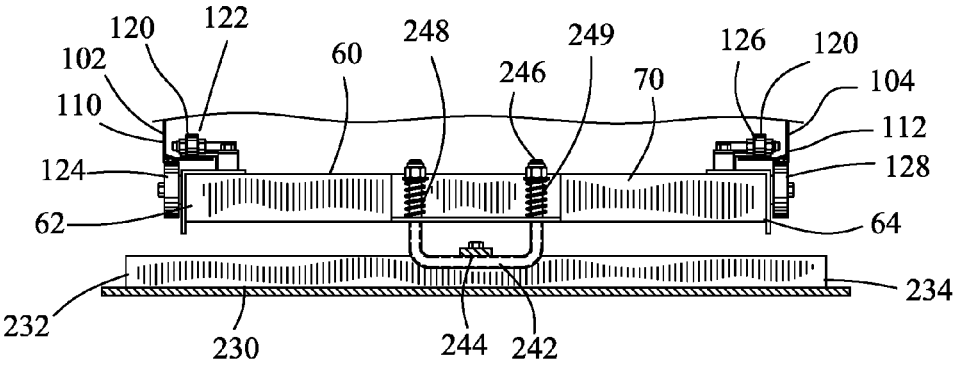
FIG. 4 is a sectional view along line 3-3 in FIG. 2, illustrating a sliding link coupling a door cover to a main frame.

As best shown in FIG. 4, the sliding link 242 may include a track 244 or bar coupled to the door cover 230 and a generally U-shape bolt 246 coupled to the main frame 60. A first spring 248 and a second spring 249 are coupled to the generally U-shape bolt 246 for applying a compression force between the main frame 60 and the staircase 100. The sliding link 242 assures that the door cover 230 will firmly engage with the upper surface 24 during the retracted length 194 in the tether 146 and the staircase 100 in the generally parallel orientation with the upper surface 24.

Figure 9:
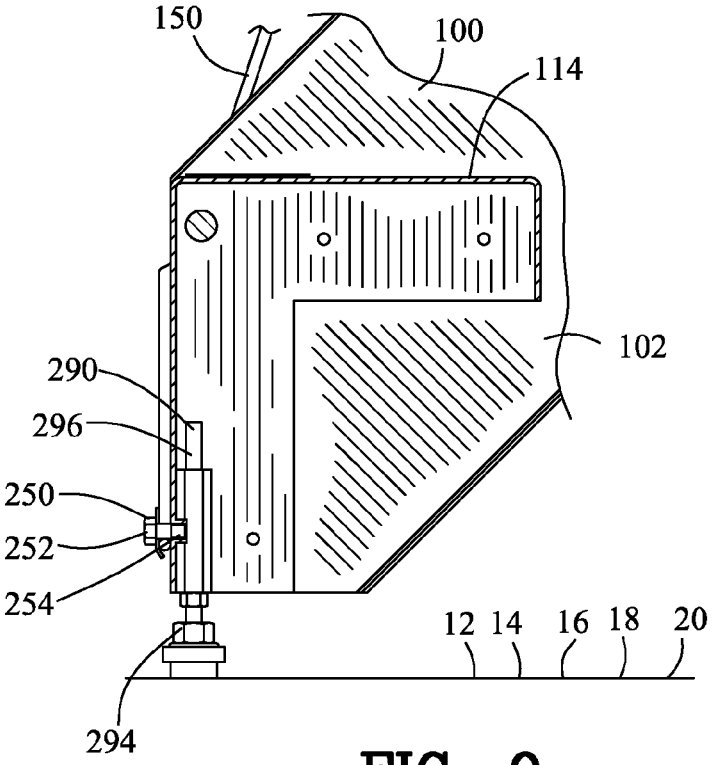
FIG. 9 is an enlarged view of a portion of FIG. 7.

As best shown in FIG. 9, a tether fastener 250 couples the tether 146 with the staircase 100. The tether fastener 250 may include a bolt 252 engaging a nut 254 applying a compressive force against the tether 146. A removable hatch 260 may engage in the door cover 230 for accessing the tether fastener 250. After removing the removable hatch 260 from the door cover 230, the tether fastener 250 is exposed. If for some reason the retractable staircase 10 is unable to be lowered from the retracted length 194 wherein the staircase 100 is in a generally parallel orientation with the upper surface 24, the tether fastener 250 may be disengaged from the staircase 100 for disengaging the tether 146 from the staircase 100 for manually lowering the staircase 100.

Figure 18:
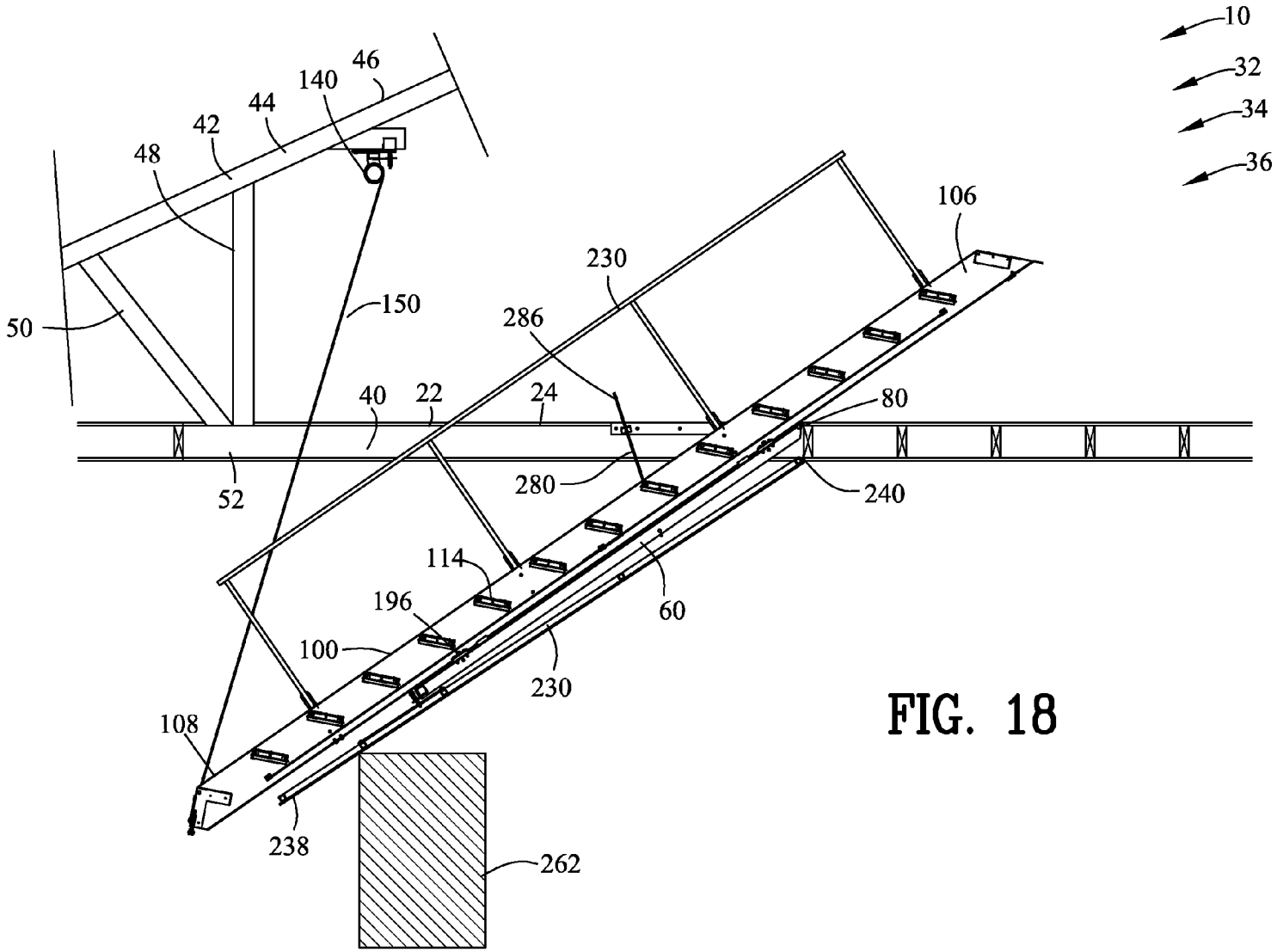
FIG. 18 is a view similar to FIG. 13 illustrating an obstruction object contacting the retractable staircase and thereafter activating a terminating switch for deactivating a drive.
Figure 20:
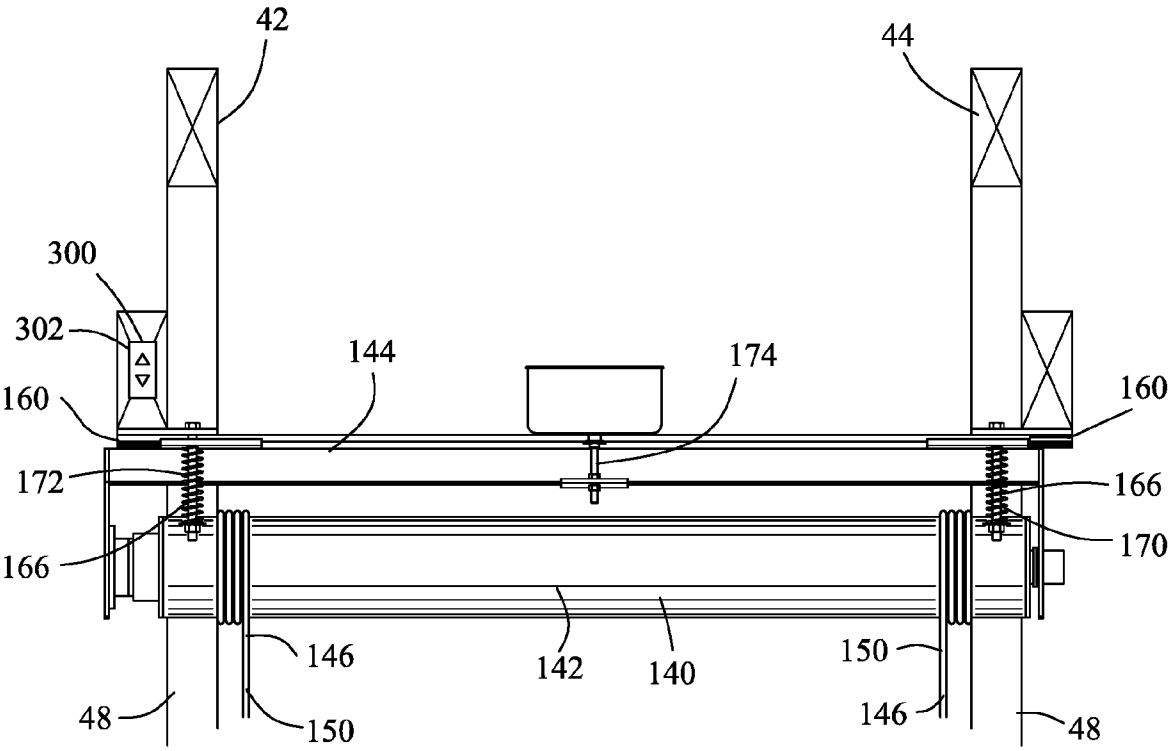
FIG. 20 is a right side view of FIG. 19.
Figure 19:
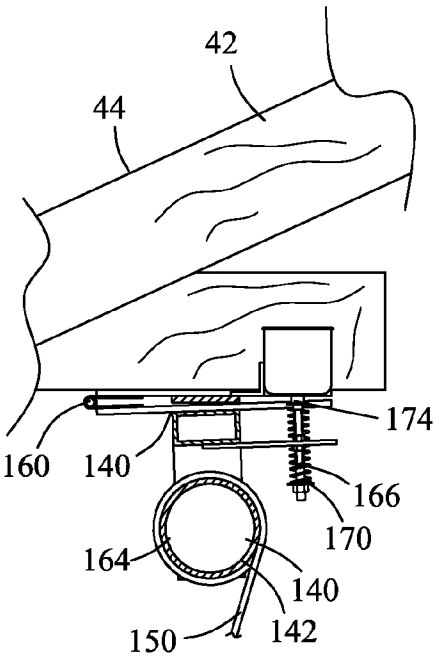
FIG. 19 is an enlarged view of a portion of FIG. 18 illustrating a bracket spring displacing the drive from a lower position to an upper position for engaging the terminating switch.

As best shown in FIGS. 18-20, the retractable staircase 10 may further include a bracket hinge 160 coupled to the motor mounting bracket 144 for pivoting the tubular motor 142 between a lower motor position 162 and an upper motor position 164. A bracket spring 166 is coupled to the bracket hinge 160 and the motor mounting bracket 144 for displacing the tubular motor 142 from the lower motor position 162 to the upper motor position 164 upon an absent in load from the staircase 100 to the tether 146. The bracket spring 166 may include a first bracket spring 170 and a second bracket spring 172 applying a compressive three for promoting the tubular motor 142 into the upper motor position 164.

A terminating switch 174 is engaged upon the tubular motor 142 positioned in the upper motor position 164 for disengaging the power source to the tubular motor 142 and terminating rotation of the tubular motor 142. More specifically, if the retractable staircase 10 is in a descending displacement and an obstruction object 262 contacts the retractable staircase 10, the tensile stress in the tether 146 will be removed causing the terminating switch 174 to halt the tubular motor 142. The obstruction object 262 may include an individual, an object, pet or other items.

In order to mount the retractable staircase 10 within the upper surface 24, a generally U-shape mounting bracket 82 may be coupled to the upper surface 24. The frame pivot 80 is coupled to the generally U-shape mounting bracket 82. For specifically, a primary U-shaped rod holder 84 and a secondary U-shaped rod holder 86 receive a mainframe rod 88 and traverse the main frame 60. A primary collar 90 and a secondary collar 92 encircle the mainframe rod 88 for permit adjustments for centering the retractable staircase 10 within the upper surface aperture 40.

The retractable staircase 10 may further include a first hanger rod 280 extending from the generally U-shape mounting bracket 82 to the primary side 102 of the staircase 100. A second hanger rod 282 extends from the generally U-shape mounting bracket 82 to the secondary side 104 of the staircase 100. Preferably, the first hanger rod 280 and the second hanger rod 282 include a pivoting end 284 at the staircase 100 and a threaded end 286 at the generally U-shape mounting bracket 82. A nut threadably engages the threaded end. 286 for creating a first hanger rod length adjustment 288 and a second hanger rod length adjustment 289 in the first hanger rod 280 and the second hanger rod 282 respectively. The first hanger rod length adjustment 288 and a second hanger rod length adjustment 289 allow for adjustments in the angle of the staircase 100 in the generally adjacent orientation with the lower surface 14. Alternatively, to the first hanger rod 280 and the second hanger rod 282, the retractable staircase 10 may utilizes adjustable scissors type told ing bracket.

The retractable staircase 10 may farther include a first lower leg 290 extending from the distal end 108 of the staircase 100. A second lower leg 292 extends from the distal end 108 of the staircase 100. The first lower leg 290 and the second lower leg 292 may include a threaded bolt 294. A first leg length adjustment 296 and a second leg length adjustment 298 are in the first lower leg 290 and the second lower leg 292 respectively, by rotation. The first leg length adjustment 296 and a second leg length adjustment 298 permit for adjusting the angle of the staircase 100 in the generally adjacent orientation with the lower surface 14. The first leg length adjustment 296 and a second leg length adjustment 298 also permit leveling the plurality of tread boards 114 due to an inconsistent or non-level lower surface 14.

A first hand rail 330 may be coupled to the primary side 102 of the staircase 100. A second hand rail 332 may be coupled to the secondary side 104 of the staircase 100. The first hand rail 330 and the second hand rail 332 preferably extend adjacent to the proximal end 106 and the distal end 108 of the staircase 100. Since the first hand rail 330 and the second hand rail 332 extend almost the entire length of the staircase 100, the safety of the individual traversing the retractable staircase 10 is greatly improved by allowing the individual to grasp the hand rail 330, 332 almost the entire length of the staircase 100.

The subject invention also incorporates a method for ascending and descending a retractable staircase 100 between a lower elevation 12 and an upper elevation 22. The method comprising the steps of displacing the staircase 100 and the main frame 60 and causing the first lifting displacement 180 in the staircase 100 and the main frame 60 for reducing the length of a tether 146 and distancing the staircase 100 from the lower surface 14 wherein the first lifting displacement 180 defines an ascending compound displacement by simultaneously causing an ascending staircase pivot displacement 182 and an ascending frame pivot displacement 184 relative to the frame pivot 80 and causing an ascending slide displacement 186 of the staircase 100 relative to the main frame 60.

Thereafter, the staircase 100 and the main frame 60 are further displaced and cause a second lifting displacement 190 in the staircase 100 and the main frame 60 for reducing the length of the tether 146 and distancing the staircase 100 from the lower surface 14 wherein the second lifting displacement 190 is defined by a lower stop 192 engaging between the main frame 60 and the staircase 100 and terminates the ascending slide displacement 186 of the staircase 100 relative to the main frame 60 and permits only the ascending staircase pivot displacement 182 and the ascending frame pivot displacement 184.

The staircase 100 and the main frame 60 are positioned and are maintained in a generally parallel orientation with the upper surface 24.

The staircase 100 and the main frame 60 are displaced and cause a first descending displacement 200 in the staircase 100 and the main frame 60 for increasing the length of the tether 146 and distancing the staircase 100 from the upper surface 24 wherein the first descending displacement 200 is defined by the lower stop 192 engaging between the main frame 60 and the staircase 100 and prevents a descending slide displacement 202 of the staircase 100 relative to the main frame 60 and permitting only a descending staircase pivot displacement 204 and a descending frame pivot displacement 206.

Thereafter, the staircase 100 and the main frame 60 are displaced and cause a second descending displacement 210 in the staircase 100 for increasing the length of the tether 146 and distancing the staircase 100 from the upper surface 24 wherein the second descending displacement 210 defines a descending compound displacement 212 by simultaneously causing the descending staircase pivot displacement 204 and the descending frame pivot displacement 206 relative to the frame pivot 80 and causing the descending slide displacement 202 of the staircase 100 relative to the main frame 60.

The staircase 100 is then positioned and maintained in a generally adjacent orientation with the lower surface 24.

A further step may include displacing, the staircase 100 and the main frame 60 and causing a third descending displacement 220 in the staircase 100 for increasing the length of the tether 146 and distancing the staircase 100 from the upper surface 24 wherein the third descending displacement 220 is defined by an upper stop 222 engaging between the main frame 60 and the staircase 100 and terminating the descending slide displacement 202 of the staircase 100 relative to the main frame 60 and permitting only the descending staircase pivot displacement 204 and the descending frame pivot displacement 206.

A further step includes pivoting a door cover 230 relative to the staircase 100 and the main frame 60 for covering the main frame 60 and the staircase 100 with the door cover 230 during the staircase 100 in tyre generally parallel orientation with the upper surface 24.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A retractable staircase for ascending and descending between a lower elevation and an upper elevation, the lower elevation having a lower surface and the upper elevation having an upper surface, the retractable staircase, comprising:

a main frame having a primary side, a secondary side and extending between a proximal end and a distal end;

a frame pivot pivoting coupling said proximal end of said main frame to the upper surface;

a staircase having a primary side, a secondary side and extending between a proximal end and a distal end;

a plurality of bearings slidably coupling said staircase to said main frame;

a drive supported above the upper surface;

a tether coupled to said drive and said staircase;

said drive causing a first lifting displacement in said staircase and said main frame for reducing the length of said tether and distancing said staircase from the lower surface;

said first lifting displacement defining an ascending compound displacement by simultaneously causing an ascending staircase pivot displacement and an ascending frame pivot displacement relative to the frame pivot and causing an ascending slide displacement of said staircase relative to said main frame;

said drive causing a second lifting displacement in said staircase and said main frame for reducing the length of said tether and distancing said staircase from the lower surface;

said second lifting displacement defined by a lower stop engaging between said main frame and said staircase and terminating said ascending slide displacement of said staircase relative to said main frame and permitting only said ascending staircase pivot displacement and said ascending frame pivot displacement;

said drive causing a retracted length in said tether for maintaining said staircase and said main frame in a generally parallel orientation with the upper surface;

said drive causing a first descending displacement in said staircase and said main frame for increasing the length of said tether and distancing said staircase from the upper surface;

said first descending displacement defined by said lower stop engaging between said main frame and said staircase and preventing a descending slide displacement of said staircase relative to said main frame and permitting only a descending staircase pivot displacement and a descending frame pivot displacement;

said drive causing a second descending displacement in said staircase for increasing the length of said tether and distancing said staircase from the upper surface;

said second descending displacement defining a descending compound displacement by simultaneously causing said descending staircase pivot displacement and said descending frame pivot displacement relative to said frame pivot and causing said descending slide displacement of said staircase relative to said main frame; and said drive causing an extended length in said tether for positioning said staircase in a generally adjacent orientation with the lower surface; said retractable staircase further including a door cover having a primary side, a secondary side and extending between a proximal end and a distal end; a door cover pivot pivoting coupling said proximal end of said door cover to the upper surface: a sliding link coupling said door cover to said main frame; and said door cover covering said main frame and said staircase during said retracted length in said tether and said staircase in said generally parallel orientation with the upper surface.

2. The retractable staircase as set forth in claim 1, further including said drive causing a third descending displacement in said staircase for increasing the length of said tether and distancing said staircase from the upper surface; and said third descending displacement defined by an upper stop engaging between said main frame and said staircase and terminating said descending slide displacement of said staircase relative to said main frame and permitting only said descending staircase pivot displaces ent and said descending frame pivot displacement.

3. The retractable staircase as set forth in claim 1, wherein said sliding link includes a track coupled to said door cover and a generally U-shape bolt coupled to said main frame; and a first spring and a second spring coupled to said generally U-shape bolt for applying a compression force between said main frame and said staircase.

4. The retractable staircase as set forth in claim 1, further including a tether fastener coupling said tether with said staircase; and a removable hatch in said door cover for accessing said tether fastener and disengaging said tether from said staircase when said staircase in said generally parallel orientation with the upper surface for manually lowering said staircase.

5. The retractable staircase as set forth in claim 1, wherein said staircase includes a primary generally C-shaped channel, a secondary generally C-shaped channel and a plurality of tread boards extending between said primary generally C-shaped channel and said secondary generally C-shaped channel; and said plurality of bearings include a plurality of primary interior rollers coupled to said main frame and rolling against the interior of said primary generally C-shaped channel, a plurality of primary exterior rollers coupled to said main frame and rolling against the exterior of said primary generally C-shaped channel, a plurality of secondary interior rollers coupled to said main frame and rolling against the interior of said secondary generally C-shaped channel, and a plurality of secondary exterior rollers coupled to said main frame and rolling against the exterior of said secondary generally C-shaped channel.

6. The retractable staircase as set forth in claim 5, further including a plurality of primary generally L-shaped brackets coupled to said primary side of said main frame and positioned adjacent to said interior of said primary generally C-shaped channel;

a plurality of secondary generally L-shaped brackets coupled to said secondary side of said main frame and positioned adjacent to said interior of said secondary generally C-shaped channel; and said plurality of primary generally L-shaped brackets and said plurality of secondary generally L-shaped brackets preventing said staircase from decoupling from said main frame.

7. The retractable staircase as set forth in claim 1, wherein said drive includes a tubular motor rotatably coupled to a motor mounting bracket;

said tether spiraling about said tubular motor for reducing the length of said tether and distancing said staircase from the lower surface; and said tether un-spiraling about said tubular motor for increasing the length of said tether and distancing said staircase from the upper surface.

8. The retractable staircase as set forth in claim 7, further including a bracket hinge coupled to said motor mounting bracket for pivoting said tubular motor between a lower motor position and an upper motor position;

a bracket spring coupled to said bracket hinge and said motor mounting bracket for displacing said tubular motor from said lower motor position to said upper motor position upon an absent in load from said staircase to said tether; and a terminating switch engaged upon said tubular motor positioned in said upper motor position for terminating rotation of said tubular motor.

9. The retractable staircase as set forth in claim 1, further including a generally U-shape mounting bracket coupled to the upper surface;

said frame pivot coupled to said generally U-shape mounting bracket;

a first hanger rod extending from said generally U-shape mounting bracket to said primary side of said staircase;

a second hanger rod extending from said generally U-shape mounting bracket to said secondary side of said staircase; and a first hanger rod length adjustment and a second hanger rod length adjustment in said first hanger rod and said second hanger rod respectively, for adjustment the angle of said staircase in said generally adjacent orientations with the lower surface.

10. The retractable staircase as set forth in claim 1, further including a first lower leg extending from said distal end of said staircase;

a second lower leg extending from said distal end of said staircase; and a first leg length adjustment and a second leg length adjustment in said first lower leg and said second lower leg respectively, for adjustment the angle of said staircase in said generally adjacent orientation with the lower surface.

11. The retractable staircase as set forth in claim 2, wherein said upper stop includes a primary stop and a secondary stop;

said primary stop includes a primary stopping block coupled to said primary side of said main frame and a first threaded rod coupled to said primary side of said staircase;

said secondary stop includes a secondary stopping block coupled to said secondary side of said main frame and a second threaded rod coupled to said secondary side of said staircase; and a first threaded rod length adjustment and a second threaded rod length adjustment in said first threaded rod and said second threaded rod respectively, for adjusting the upper stop dimension of said staircase relative to said main frame and adjusting the angle of said staircase in said generally adjacent orientation with the lower surface.

12. The retractable staircase as set forth in claim 1, further including a first hand rail coupled to said primary side of said staircase; and a second hand rail coupled to said secondary side of said staircase.

13. A method for ascending and descending said retractable staircase as set forth in claim 1 between said lower elevation and said upper elevation, the lower elevation having said lower surface and the upper elevation having said upper surface, the method comprising the steps of:

displacing said staircase and said main frame and causing said first lifting displacement in said staircase and said main frame for reducing the length of said tether and distancing the staircase from the lower surface wherein the first lifting displacement defining said ascending compound displacement by simultaneously causing said ascending staircase pivot displacement and said ascending frame pivot displacement relative to the frame pivot and causing said ascending slide displacement of the staircase relative to the main frame;

displacing the staircase and the main frame and causing said second lifting displacement in the staircase and the main frame for reducing the length of the tether and distancing the staircase from the lower surface wherein the second lifting displacement defined by said lower stop engaging between the main frame and the staircase and terminating the ascending slide displacement of the staircase relative to the main frame and permitting only the ascending staircase pivot displacement and the ascending frame pivot displacement;

positioning and maintaining the staircase and the main frame in said generally parallel orientation with the upper surface;

displacing the staircase and the main frame and causing said first descending displacement in the staircase and the main frame for increasing the length of the tether and distancing the staircase from the upper surface wherein the first descending displacement defined by the lower stop engaging between the main frame and the staircase and preventing said descending slide displacement of the staircase relative to the main frame and permitting only said descending staircase pivot displacement and said descending frame pivot displacement;

displacing the staircase and the main frame and causing said second descending displacement in the staircase for increasing the length of the tether and distancing the staircase from the upper surface wherein the second descending displacement defining said descending compound displacement by simultaneously causing the descending staircase pivot displacement and the descending frame pivot displacement relative to the frame pivot and causing the descending slide displacement of the staircase relative to the main frame; and positioning and maintaining the staircase in said generally adjacent orientation with the lower surface.

14. The method for ascending and descending a retractable staircase as set forth in claim 13, further including the step of displacing the staircase and the main frame and causing a third descending displacement in the staircase for increasing the length of the tether and distancing the staircase from the upper surface wherein the third descending displacement defined by an upper stop engaging between the main frame and the staircase and terminating the descending slide displacement of the staircase relative to the main frame and permitting only the descending staircase pivot displacement and the descending frame pivot displacement.

15. The method for ascending and descending a retractable staircase as set forth in claim 13, further including a step of a pivoting said door cover relative to the staircase and the main frame for covering the main frame and the staircase with the door cover during the staircase in the generally parallel orientation with the upper surface.

* * * * *